United States Patent [19]

Blasczyk et al.

[11] Patent Number: 4,783,012

[45] Date of Patent: Nov. 8, 1988

[54] METHOD AND APPARATUS FOR THE TWO-STAGE CRUSHING OF BRITTLE MATERIAL FOR GRINDING

[75] Inventors: Gotthardt Blasczyk; Norbert Patzelt; Heinz-Georg Mersmann, all of Beckum; Franz J. Adrian, Lippetal; Hardy Kropf, Oelde, all of Fed. Rep. of Germany

[73] Assignee: Krupp Polysius AG, Fed. Rep. of Germany

[21] Appl. No.: 130,989

[22] Filed: Dec. 10, 1987

[30] Foreign Application Priority Data

Dec. 23, 1986 [DE] Fed. Rep. of Germany ..... 3644342

[51] Int. Cl.[4] ..... B02C 25/00

[52] U.S. Cl. ..... 241/24; 241/29; 241/34; 241/80; 241/152 A

[58] Field of Search ..... 241/152 A, 34, 29, 35, 241/24, 79.1, 80, 97

[56] References Cited

U.S. PATENT DOCUMENTS 4,690,335 9/1987 Allers et al. ..... 241/152 A X 4,726,531 2/1988 Strasser ..... 241/152 A X

*Primary Examiner*—Mark Rosenbaum

*Attorney, Agent, or Firm*—Learman & McCulloch

[57] ABSTRACT

A method and apparatus for the two-stage crushing of brittle material comprising a roll mill and a second mill downstream thereof, the output of the second mill being delivered to a sifter. The quantity of grit obtained in the sifting operation is divided between the roll mill and the second mill in such a way that the sum of the quantity of fresh material and the quantity of grit delivered to the roll mill remains constant.

6 Claims, 1 Drawing Sheet

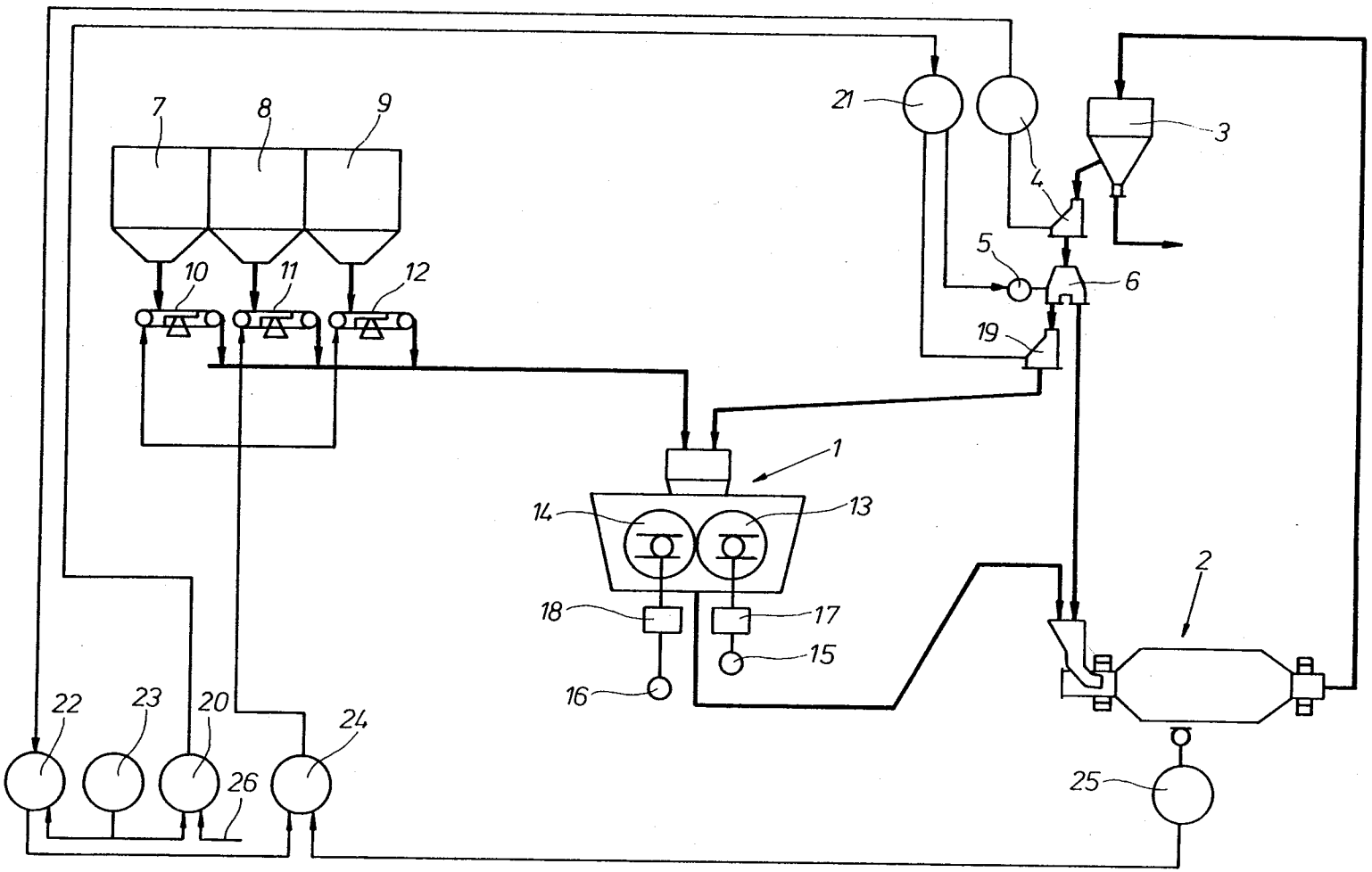
1
2
3
4
5
6
7
8
9
10
11
12
13
14
15
16
17
18
19
20
21
22
23
24
25
26

METHOD AND APPARATUS FOR THE TWO-STAGE CRUSHING OF BRITTLE MATERIAL FOR GRINDING

The invention relates to a method and apparatus for the two-stage crushing of brittle material that subsequently is to be ground.

BACKGROUND OF THE INVENTION

A method and apparatus of the general type to which the invention relates are the subject matter of German Patent Application No. P 35 20 069.3. In this earlier method and apparatus the branch stream of grit delivered to the roll mill is of such a quantity that an almost constant material level is maintained in the delivery shaft of the roll mill even when the quantity of fresh material changes.

The object of the invention is to provide an improved method and apparatus which enables in such a system the highest possible saving of energy and the lowest possible specific power requirement for crushing the material.

THE DRAWING

The single drawing FIGURE is a schematic illustration of one embodiment of the invention.

DETAILED DESCRIPTION

The illustrated apparatus for the two-stage crushing of brittle material, for example cement clinker, contains a first or roll mill 1 and a second mill 2 downstream of the roll mill 1 and which is preferably constructed as a ball mill.

The apparatus also contains a sifter 3 for sifting the material discharged from the second mill 2 to produce grit and a finished product.

Measuring apparatus 4 is also provided for determining the quantity of grit obtained in the sifting operation. A regulating valve 6 provided with a motor 5 is connected to the measuring apparatus 4 and serves to divide the quantity of grit obtained in the sifting operation into one branch stream which is delivered to the roll mill 1 and one branch stream which is delivered to the second mill 2.

The material which is to be crushed is located in storage vessels 7, 8, 9 (which are for example associated with individual components). It is delivered to the roll mill 1 by means of dosaging conveyor-type weighers 10, 11, 12.

The roll mill 1 contains two rolls 13, 14 of which the roll 13 is constructed as a fixed roll and the roll 14 as a releasable roll. The two rolls are pressed against one another at a high pressure and are driven by electric motors 15, 16 via gear units 17, 18.

The measuring apparatus 4, which determines the total quantity of grit obtained in the sifting operation, is connected to a regulator 22 which receives a signal from a summation element 23 corresponding to the quantity of fresh material just delivered (i.e. the sum of the quantities of material taken from the storage vessels 7, 8, 9). The regulator 22 is connected by a switching element 24 to the drives of the dosaging conveyor-type weighers 10, 11, 12.

A control circuit contains a second measuring apparatus 19 to determine the quantity of grit delivered to the roll mill 1, a computing element 20 and a regulator 21. A signal corresponding to the quantity of fresh material at that moment is delivered from the summation element 23 to the first regulator 22. It also contains a predetermined theoretical value (26) for the sum of the quantity of fresh material and the quantity of grit returned to the roll mill. From this the computing element 20 forms a theoretical value for the quantity of grit returned to the roll mill. This theoretical value is passed to the second regulator 21.

In addition to this theoretical value formed by the computing element 20, the regulator 21 also receives a signal from the measuring apparatus 19 which corresponds to the quantity of grit returned to the roll mill 1. From this the regulator 21 forms a control signal which is delivered to the servo motor 5 of the regulating valve 6.

Finally, the apparatus also contains an known monitoring means 25 which is also connected to the switching element 24 and serves to monitor the level of material in the second mill 2.

The apparatus functions as follows:

The first material delivered to the roll mill 1 undergoes material bed crushing in the roll gap of the roll mill and at the same time, at the appropriate grain size, undergoes individual grain crushing. The agglomerates obtained in the material bed crushing are broken up in the second mill 2. If required, the material undergoes further crushing in the second mill 2.

The material discharged from the mill 2 is sifted in the sifter 3. Of the quantity of grit obtained in this operation one branch stream is delivered via the regulating valve 6 and the measuring apparatus 19 to the roll mill 1 and a further branch stream is delivered via the regulating valve 6 to the mill 2.

By means of a first control circuit which contains the measuring apparatus 4 and the regulator 22 the quantity of fresh material delivered to the roll mill 1 via the dosaging conveyor-type weighers 10, 11, 12 is regulated as a function of the total quantity of grit obtained in the sifting operation and in such a way that the sum of the quantity of fresh material and the total quantity of grit delivered to the roll mill remains constant.

By means of a second control circuit which contains the measuring apparatus 19, the regulating valve 6 and the computing element 20 and the regulator 21 the quantity of grit obtained in the sifting operation is divided into branch streams which are delivered to the roll mill 1 and the second mill 2 in such a way that the sum of the quantity of fresh material and the quantity of grit delivered to the roll mill remains constant. The roll mill 1 is therefore driven with a constant quantity of material per unit of time (t/h).

During this the roll mill 1 advantageously runs at a constant speed.

If the level of material in the mill 2 exceeds a predetermined maximum value, the monitoring apparatus arrangement 25 passes a signal to the switching element 24 and interrupts the control of the quantity of fresh material which takes place as described above as a function of the total quantity of grit (i.e. the first control circuit) until the level of material in the mill 2 has returned to normal.

We claim:

1. A two-stage method of crushing fresh brittle material wherein said fresh material is delivered to a first mill and crushed to form agglomerates, said agglomerates are delivered to a second mill and further crushed to form an output that is delivered to a sifter and sifted to produce a finished product and grit, and said grit is separated into two streams the first of which is delivered to said first mill and the second of which is delivered to said second mill, the improvement comprising regulating the quantity of fresh material delivered to the first mill with respect to the total quantity of output from the second mill so that the sum of the quantity of fresh material and said output remains substantially constant; and regulating the quantities of grit delivered to the first and second mills so that the sum of the quantity of fresh material and the quantity of grit delivered to the first mill remains substantially constant.

2. The method according to claim 1 including monitoring the level of material in the second mill and interrupting the delivery of fresh material to the first mill whenever a predetermined maximum value of the contents of the second mill is exceeded until such time as the value of the contents of second mill is not more than said maximum value.

3. The method according to claim 1 including operating said first mill at a constant speed.

4. In apparatus for the two-stage crushing of brittle fresh material having a first mill, means for delivering fresh material to said first mill, a second mill downstream from said first mill for receiving material from said first mill, a sifter downstream from said second mill for receiving material from said second mill and separating a finished product from grit, means for dividing said grit into two streams, and means for delivering one of said streams of grit to said first mill and the other of said streams of grit to said second mill, the improvement comprising first regulating means for regulating the quantity of fresh material delivered to said first mill with respect to the quantity of ground material discharged from said second mill so that the total quantity of said fresh material and said ground material remains constant; and second regulating means for regulating the quantities of said grit delivered to said first and second mills so that the sum of the quantity of fresh material and the quantity of grit delivered to said first mill is substantially constant.

5. Apparatus according to claim 4 including means for measuring the quantity of grit delivered to said first mill; computer means for establishing a theoretical value for the quantity of grit delivered to said first mill from the quantity of fresh material at that time and a predetermined theoretical value for the sum of the quantity of fresh material and the quantity of grit returned to said first mill; and a regulator interconnecting said computer means and said measuring means for regulating the quantity of grit in each of said streams.

6. Apparatus according to claim 4 including means for monitoring the level of material in said second mill; and switching means operable in response to said level's reaching a predetermined maximum value to interrupt the delivery of fresh material to said first mill until the said level in said second mill is reduced.

* * * * *